US009124075B2

(12) United States Patent
Yamada et al.

(10) Patent No.: US 9,124,075 B2
(45) Date of Patent: Sep. 1, 2015

(54) IGNITION SYSTEM

(71) Applicant: NGK Spark Plug Co., Ltd., Nagoya-shi, Aichi (JP)

(72) Inventors: Tatsunori Yamada, Aichi-ken (JP); Kenji Ban, Gifu-ken (JP); Tomokatsu Kashima, Aichi-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 23 days.

(21) Appl. No.: 14/173,867

(22) Filed: Feb. 6, 2014

(65) Prior Publication Data

US 2014/0226251 A1 Aug. 14, 2014

(30) Foreign Application Priority Data

Feb. 14, 2013 (JP) ..... 2013-026210

(51) Int. Cl.
*H01T 13/32* (2006.01)
*H01T 13/20* (2006.01)
*F02P 3/04* (2006.01)

(52) U.S. Cl.
CPC ..... *H01T 13/32* (2013.01); *F02P 3/0435* (2013.01); *H01T 13/20* (2013.01)

(58) Field of Classification Search
USPC ..... 313/118–145
See application file for complete search history.

(56) References Cited

U.S. PATENT DOCUMENTS

| | | | | |
|---|---|---|---|---|
| 5,578,894 | A | 11/1996 | Oshima | 313/141 |
| 2004/0012318 | A1* | 1/2004 | Ishikawa | 313/141 |
| 2009/0194053 | A1 | 8/2009 | Nakamura et al. | 123/143 |
| 2009/0244802 | A1* | 10/2009 | Takeuchi et al. | 361/247 |

FOREIGN PATENT DOCUMENTS

| | | | |
|---|---|---|---|
| JP | S50-157732 | 12/1975 | H01J 13/20 |
| JP | 5-343157 | 12/1993 | H01T 13/39 |
| JP | 2006-236906 | 9/2006 | H01T 21/02 |
| JP | 2009-158339 | 7/2009 | H01T 13/32 |
| JP | 2009-259776 | 11/2009 | H01T 13/52 |
| JP | 2011-175980 | 9/2011 | H01T 13/32 |

OTHER PUBLICATIONS

Notification of Reason for Rejection received in connection with Japanese Patent Application No. 2013-026210 (English-language translation included) dated Jan. 6, 2015.

* cited by examiner

*Primary Examiner* — Mariceli Santiago
*Assistant Examiner* — Brenitra M Lee
(74) *Attorney, Agent, or Firm* — Kusner & Jaffe

(57) ABSTRACT

An ignition system that sufficiently utilizes the energy output from a power supply, to thereby realize excellent ignition performance. The ignition system includes an ignition plug having a spark discharge gap formed between a center electrode and a ground electrode, and a power supply for supplying electric energy to the spark discharge gap. Electric energy output from the power supply for producing spark discharge of one unit is set to 100 mJ or greater. $S1 \geq [\{-30\ (mm^{-1}) \times G1+60\}/100] \times S2$ and $G1<2.0$ are satisfied wherein G1 represents the size (mm) of the spark discharge, S1 represents an area ($mm^2$) defined with a region obtained by removing, from a projection region of the center electrode, a region where the projection region overlaps with a projection region of the ground electrode and S2 represents an area ($mm^2$) defined with the projection region of the center electrode.

5 Claims, 11 Drawing Sheets

IGNITION SYSTEM

FIELD OF THE INVENTION

The present invention relates to an ignition system which includes an ignition plug and which is used for an internal combustion engine or the like.

BACKGROUND OF THE INVENTION

An ignition system, which is used for igniting, for example, a fuel-air mixture within a combustion chamber, includes an ignition plug mounted to an internal combustion engine or the like, and a power supply which applies electric energy to the ignition plug. In general, such an ignition plug includes an insulator having an axial hole extending in the axial direction, a center electrode inserted into a forward end portion of the axial hole, a metallic shell provided around the insulator, and a rod-shaped ground electrode fixed to a forward end portion of the metallic shell. A spark discharge gap is formed between a distal end portion of the ground electrode and a forward end portion of the center electrode. When electric energy is supplied from the power supply to the spark discharge gap, spark discharge is produced, whereby the fuel-air mixture or the like is ignited (see, for example, Japanese Patent Application Laid-Open (kokai) No H5-343157 "Patent Document 1," etc.).

Also, there has been proposed a technique of improving the ignition performance and durability of such an ignition plug by providing a protrusion formed of a noble metal alloy or the like on the distal end portion of the ground electrode (see, for example, Japanese Patent Application Laid-Open (kokai) No 2009-158339 "Patent Document 2," etc.).

In recent years, a lean burn engine, a direct injection engine, a low emission engine, etc. have been actively developed so as to cope with emission control and improve fuel consumption. In such an engine, a higher ignition performance is needed.

The present invention has been accomplished in view of the above circumstances, and an object of the invention is to provide an ignition system which sufficiently utilizes the energy which is output from a power supply so as to produce spark discharge, to thereby realize excellent ignition performance.

SUMMARY OF THE INVENTION

Configurations suitable for achieving the above object will next be described in itemized form. If needed, actions and effects peculiar to the configurations will be described additionally.

Configuration 1: an ignition system of the present configuration comprises:

an ignition plug including a tubular insulator having an axial hole extending in the direction of an axis, a center electrode inserted into a forward end portion of the axial hole, and a rod-shaped ground electrode which forms a gap in cooperation with a forward end portion of the center electrode; and a power supply for supplying electric energy to the gap, wherein spark discharge is produced at the gap when electric energy is supplied from the power supply to the gap, the ignition system being characterized in that the electric energy output from the power supply for producing spark discharge of one unit is 100 mJ or greater; and $S1 \geq [\{-30\ (mm^{-1}) \times G1 + 60\}/100] \times S2$ and $G1 < 2.0$ are satisfied wherein G1 represents the size (mm) of the gap, and when the forward end portion of the center electrode and the ground electrode are projected along the axis on a plane orthogonal to the axis, S1 represents an area ($mm^2$) defined with a region obtained by removing, from a projection region of the center electrode, a region where the projection region overlaps with a projection region of the ground electrode, and S2 represents an area ($mm^2$) defined with the projection region of the center electrode.

The term "spark discharge of one unit" refers to spark discharge during a single cycle of an internal combustion engine or the like. For example, in the case of a four-stroke engine having four strokes; i.e., an intake stroke, a compression stroke, an ignition (expansion) stroke, and an exhaust stroke, the intake stroke, the compression stroke, the ignition (expansion) stroke, and the exhaust stroke form a single cycle. In the case of a two-stroke engine having two strokes; i.e., an intake/compression stroke and an ignition/exhaust stroke, the intake/compression stroke and the ignition/exhaust stroke form a single cycle.

According to the above-described configuration 1, the electric energy output from the power supply for producing spark discharge of one unit is set to 100 mJ or greater. Accordingly, it is possible not only to merely produce spark (flame) at the gap by using the electric energy, but also to apply a spreading force toward the forward end side (toward the center of a combustion chamber) to the spark (flame) by using the electric energy.

According to the above-described configuration 1, in the configuration in which a spreading force toward the forward end side is applied to spark (flame), $S1 \geq [\{-30\ (mm^{-1}) \times G1 + 60\}/100] \times S2$ is satisfied. Namely, the smaller the size G1 of the gap, the greater the degree to which spreading of spark (flame) toward the forward end side is hindered by the ground electrode, and the greater the ratio S1/S2, the smaller the degree to which spreading of spark (flame) is hindered by the ground electrode. In the above-described configuration 1, since $S1 \geq [\{-30\ (mm^{-1}) \times G1 + 60\}/100] \times S2$ is satisfied, it is possible to effectively prevent the ground electrode from hindering spreading of spark (flame) toward the forward end side. Accordingly, a spreading force toward the forward end side produced by setting the output energy to 100 mJ or greater can be utilized sufficiently, whereby the spark (flame) can be quickly grown toward the forward end side (toward the center of a combustion chamber). As a result, excellent ignition performance can be realized.

Configuration 2: an ignition system of the present configuration is characterized in that, in the above-described configuration 1, $S1 \leq 0.8 \times S2$ is satisfied.

According to the above-described configuration 2, the facing area between the center electrode and the ground electrode can be secured sufficiently at the gap. Accordingly, local wear of the center electrode and/or the ground electrode due to spark discharge can be suppressed more reliably, whereby good durability can be obtained.

Configuration 3: an ignition system of the present configuration comprises:

an ignition plug including a tubular insulator having an axial hole extending in the direction of an axis, a center electrode inserted into a forward end portion of the axial hole, a metallic shell provided around the insulator, a rod-shaped ground electrode disposed on a forward end portion of the metallic shell, and a protrusion which is provided on a distal end portion of the ground electrode and which forms a gap in cooperation with a forward end portion of the center electrode; and a power supply for supplying electric energy to the gap, wherein spark discharge is produced at the gap when electric energy is supplied from the power supply to the gap, the ignition system being characterized in that the electric energy output from the power supply for producing spark discharge of one unit is 100 mJ or greater; and $S3 \geq [\{-30\ (mm^{-1}) \times G3+60\}/100] \times S2$, $S4 \geq [\{-30\ (mm^{-1}) \times G4+60\}/100] \times S2$, $G3<2.0$, and $G4<2.0$ are satisfied wherein G3 represents the size (mm) of the gap, G4 represents the shortest distance (mm) between the ground electrode and the forward end portion of the center electrode, and when the forward end portion of the center electrode, the ground electrode, and the protrusion are projected along the axis on a plane orthogonal to the axis, S2 represents an area ($mm^2$) defined with a projection region of the center electrode, S3 represents an area ($mm^2$) defined with a region obtained by removing a projection region of the protrusion from the projection region of the center electrode, and S4 represents an area ($mm^2$) defined with a region obtained by removing a projection region of the ground electrode and the projection region of the protrusion from the projection region of the center electrode.

According to the above-described configuration 3, in an ignition system in which a protrusion is provided on a distal end portion of the ground electrode, an action and an effect similar to those of the above-described configuration 1 can be attained. Namely, a spreading force toward the forward end side is applied to spark (flame) by setting the output energy to 100 mJ or greater, and the spreading force can be utilized sufficiently by configuring the ignition system such that the areas S3 and S4 satisfy the above-described expressions. Thus, the spark (flame) can be quickly grown toward the forward end side (toward the center of a combustion chamber). As a result, excellent ignition performance can be realized.

Configuration 4: an ignition system of the present configuration is characterized in that, in the above-described configuration 3, at least one of $S3 \leq 0.8 \times S2$ and $S4 \leq 0.8 \times S2$ is satisfied.

According to the above-described configuration 4, since $S3 \leq 0.8 \times S2$ is satisfied, the facing area between the protrusion and the center electrode can be secured sufficiently at the gap. Accordingly, local wear of the protrusion and/or the center electrode due to spark discharge can be suppressed more reliably, whereby durability can be improved.

Also, since $S4 \leq 0.8 \times S2$ is satisfied, the facing area between "the protrusion and the ground electrode" and the center electrode can be secured sufficiently. As a result, local wear of the ground electrode and/or the center electrode can be suppressed, whereby durability can be improved.

From the viewpoint of realizing further improved durability, the ignition system is preferably configured to satisfy both of $S3 \leq 0.8 \times S2$ and $S4 \leq 0.8 \times S2$.

Configuration 5: an ignition system of the present configuration is characterized in that, in any one of the above-described configurations 1 to 4, when the forward end portion of the center electrode, the ground electrode, and a center axis of the ground electrode are projected along the axis on a plane orthogonal to the axis, at least a portion of the projection region of the ground electrode overlaps with the projection region of the center electrode, and a projection line of the center axis is located at a position offset from the center of the projection region of the center electrode.

According to the above-described configuration 5, a corner portion between a surface of the ground electrode located on the side toward the center electrode and a side surface adjacent to the surface (a portion where electric field intensity becomes high and from which spark discharge starts) can be made closer to the forward end portion of the center electrode. Accordingly, a larger number of portions from which spark discharge starts can be formed, whereby local wear of the center electrode and/or the ground electrode can be suppressed more effectively. As a result, durability can be improved further.

DETAILED DESCRIPTION OF THE INVENTION

Embodiments will now be described with reference to the drawings.

First Embodiment

Figure 1:
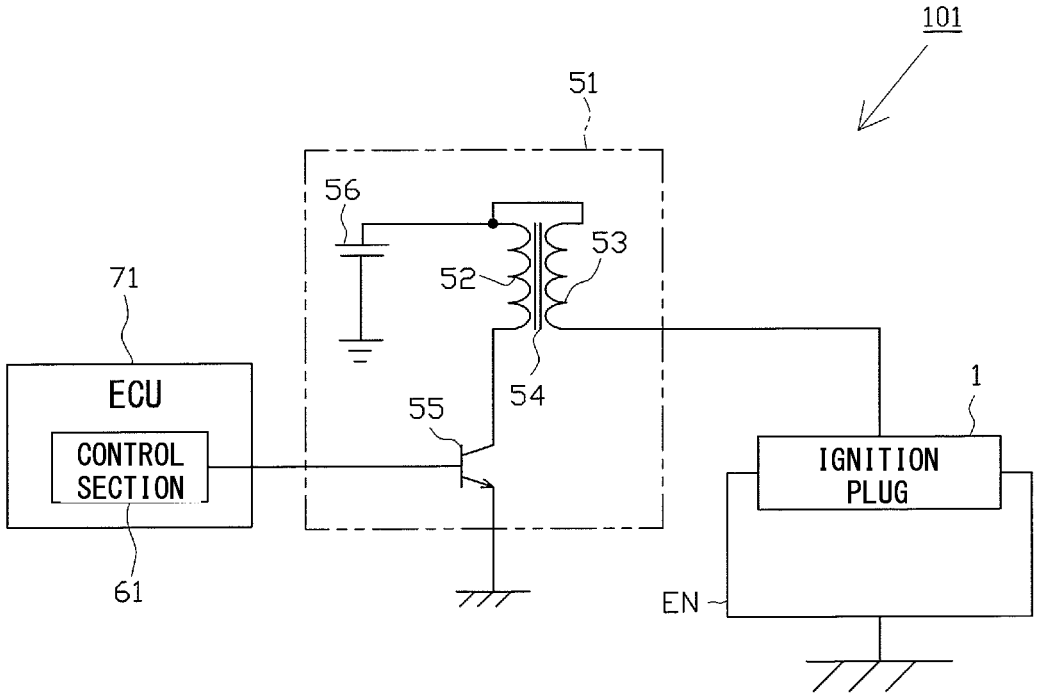
FIG. 1 is a block diagram schematically showing the configuration of an ignition system.

FIG. 1 is a block diagram schematically showing the configuration of an ignition system 101. As shown in FIG. 1, the ignition system 101 includes an ignition plug 1 mounted to an internal combustion engine EN, and a power supply 51 for supplying electric energy to the ignition plug 1. In FIG. 1, only one ignition plug 1 is illustrated. However, in actuality, the internal combustion engine EN has a plurality of cylinders, and the ignition plug 1 is provided for each of the cylinders. The electric energy from the power supply 51 is supplied to each ignition plug 1 through an unillustrated distributer.

Figure 2:
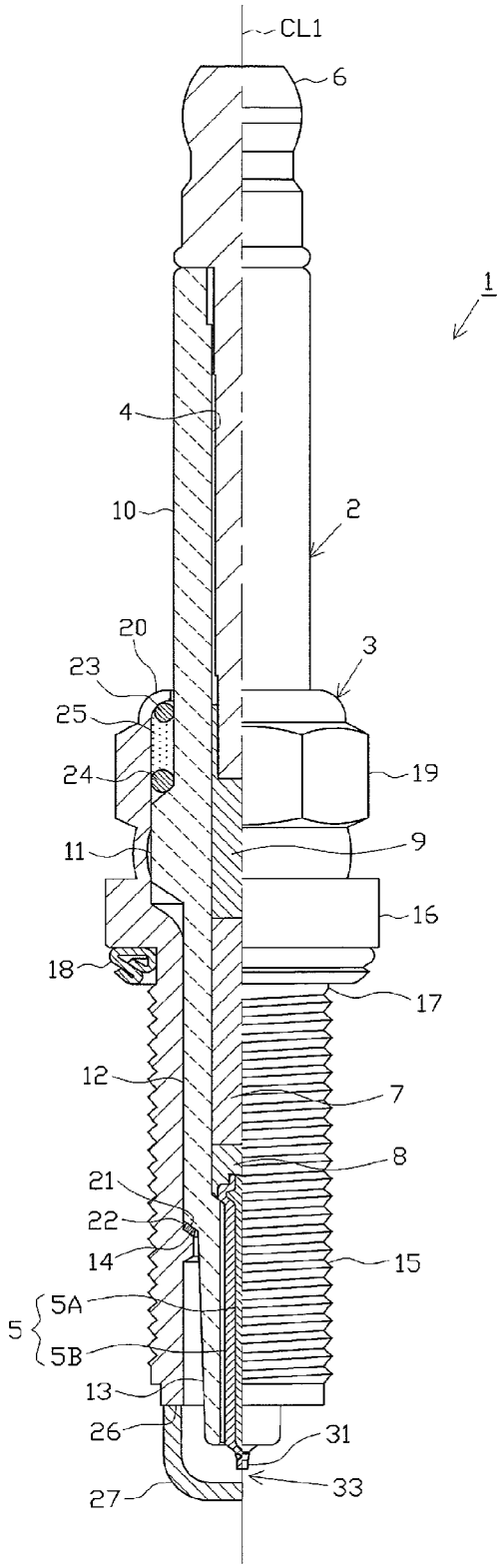
FIG. 2 is a partially cutaway front view showing the structure of an ignition plug.

As shown in FIG. 2, the ignition plug 1 includes a tubular insulator 2, a tubular metallic shell 3, which holds the insulator 2, etc. Notably, in the following description, the direction of an axis CL1 of the ignition plug 1 in FIG. 2 is referred to as the vertical direction, and the lower side of FIG. 2 is referred to as the forward end side of the ignition plug 1, and the upper side as the rear end side of the ignition plug 1.

The insulator 2 is formed from alumina or the like by firing, as well known in the art. The insulator 2 includes a rear trunk portion 10, a large-diameter portion 11, an intermediate trunk portion 12, and a leg portion 13, which portions define the outward shape of the insulator 2. The rear trunk portion 10 is formed on the rear end side. The large-diameter portion 11 is located forward of the rear trunk portion 10 and projects radially outward. The intermediate trunk portion 12 is located forward of the large-diameter portion 11 and is smaller in diameter than the large-diameter portion 11. The leg portion 13 is located forward of the intermediate trunk portion 12 and is smaller in diameter than the intermediate trunk portion 12. The large-diameter portion 11, the intermediate trunk portion 12, and the greater part of the leg portion 13 of the insulator 2 are accommodated in the metallic shell 3. A tapered, stepped portion 14 is formed at a connection portion between the intermediate trunk portion 12 and the leg portion 13. The insulator 2 is seated on the metallic shell 3 via the stepped portion 14.

The insulator 2 has an axial hole 4 extending therethrough along the axis CL1. A center electrode 5 is fixedly inserted into a forward end portion of the axial hole 4. The center electrode 5 includes an inner layer 5A formed of a metal which is excellent in thermal conductivity (e.g., copper, copper alloy, or pure nickel (Ni)), and an outer layer 5B formed of an alloy which contains Ni as a main component. A cylindrical columnar tip 31 is provided on a forward end portion of the center electrode 5. The tip 31 is formed of a metal which is excellent in wear resistance (e.g., iridium (Ir), platinum (Pt), rhodium (Rh), ruthenium (Ru), rhenium (Re), tungsten (W), palladium (Pd), or an alloy which contains at least one of these metals as a main component). The center electrode 5 (the tip 31) has a flat forward end surface, and its forward end portion projects from the forward end of the insulator 2.

A terminal electrode 6 is fixedly inserted into a rear end portion of the axial hole 4 and projects from the rear end of the insulator 2.

A cylindrical columnar resistor 7 is disposed in the axial hole 4 to be located between the center electrode 5 and the terminal electrode 6. Opposite ends of the resistor 7 are electrically connected to the center electrode 5 and the terminal electrode 6, respectively, via electrically conductive glass seal layers 8 and 9.

The metallic shell 3 is formed from a metal such as low-carbon steel into a tubular shape. The metallic shell 3 has a threaded portion (externally threaded portion) 15 on its outer circumferential surface. The threaded portion 15 is used to mount the ignition plug 1 to a mount hole of an internal combustion engine or the like. The metallic shell 3 has a flanged seat portion 16 formed rearward of the threaded portion 15. A ring-like gasket 18 is fitted to a screw neck 17 located at the rear end of the threaded portion 15. The metallic shell 3 also has a tool engagement portion 19 provided on the rear end side thereof. The tool engagement portion 19 has a hexagonal cross section and allows a tool such as a wrench to be engaged therewith when the metallic shell 3 is to be mounted to the internal combustion engine or the like. Further, the metallic shell 3 has a crimp portion 20 provided at its rear end portion and adapted to hold the insulator 2.

Also, the metallic shell 3 has a tapered stepped portion 21 provided on the inner circumferential surface thereof and adapted to allow the insulator 2 to be seated thereon. The insulator 2 is inserted forward into the metallic shell 3 from the rear end of the metallic shell 3. In a state in which the stepped portion 14 of the insulator 2 butts against the stepped portion 21 of the metallic shell 3, a rear-end opening portion of the metallic shell 3 is crimped radially inward; i.e., the crimp portion 20 is formed, whereby the insulator 2 is fixed to the metallic shell 3. An annular sheet packing 22 is interposed between the stepped portions 14 and 22. This retains gastightness of a combustion chamber and prevents leakage of a fuel gas to the exterior of the ignition plug 1 through the clearance between the inner circumferential surface of the metallic shell 3 and the leg portion 13 of the insulator 2, which is exposed to the interior of the combustion chamber.

In order to ensure gastightness which is established by crimping, annular ring members 23 and 24 intervene between the metallic shell 3 and the insulator 2 in a region near the rear end of the metallic shell 3, and the space between the ring members 23 and 24 is filled with powder of talc 25. That is, the metallic shell 3 holds the insulator 2 via the sheet packing 22, the ring members 23 and 24, and the talc 25.

Figure 3:
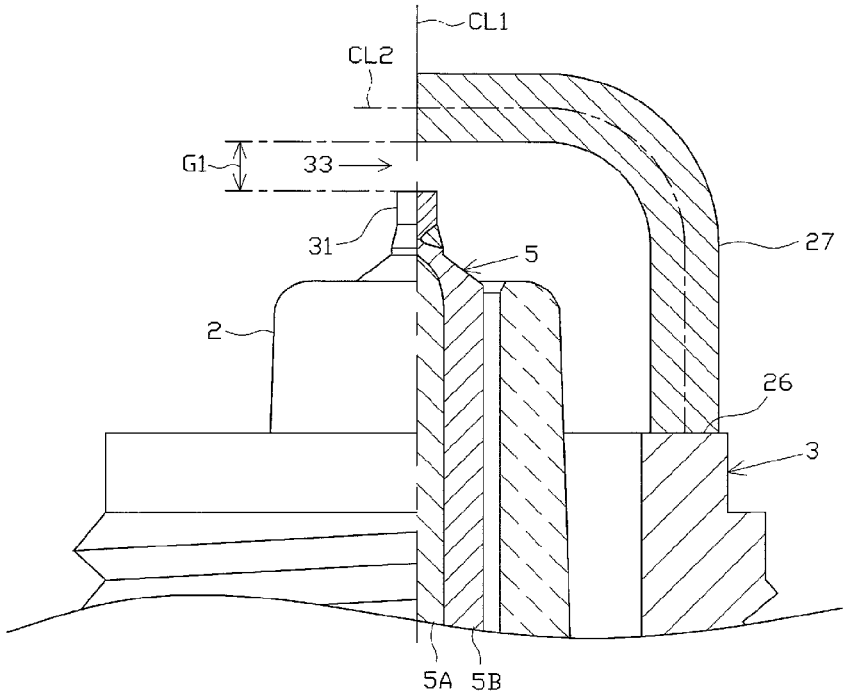
FIG. 3 is a partially cutaway enlarged front view showing the structure of a forward end portion of the ignition plug.

Also, as shown in FIG. 3, a rod-shaped ground electrode 27 is joined to a forward end portion 26 of the metallic shell 3. The ground electrode 27 is bent at its intermediate portion, and a side surface of a distal end portion of the ground electrode 27 faces the forward end surface of the center electrode 5. The ground electrode 27 is formed of an alloy which contains Ni as a main component (e.g., an alloy which contains Ni as a main component, and also contains at least one of silicon, aluminum, and rare earth elements). A spark discharge gap 33 is formed between the distal end portion of the ground electrode 27 and the forward end portion of the center electrode 5. When electric energy is supplied from the power supply 51 to the spark discharge gap 33, spark discharge is produced at the spark discharge gap 33. In the present embodiment, the size G1 of the spark discharge gap 33 (mm; the shortest distance between the center electrode 5 and the ground electrode 27) is smaller than 2.0 mm. Notably, in the present embodiment, the size G1 of the spark discharge gap 33 is set to be equal to or greater than a predetermined value (e.g., 0.3 mm or greater).

Referring back to FIG. 1, the power supply 51, which supplies electric energy to the ignition plug 1 so as to generate spark discharge at the spark discharge gap 33, includes a primary coil 52, a secondary coil 53, a core 54, and an igniter 55.

The primary coil 52 is wound around the core 54. One end of the primary coil 52 is connected to a battery 56 for supplying electric power, and the other end of the primary coil 52 is connected to the igniter 55. The secondary coil 53 is also wound around the core 54. One end of the secondary coil 53 is connected to a line between the primary coil 52 and the battery 56, and the other end of the secondary coil 53 is connected to the terminal electrode 6 of the ignition plug 1.

The igniter 55 is formed of a predetermined transistor, and performs switching so as to permit and prohibit the supply of electric power from the battery 56 to the primary coil 52 in accordance with an energization signal sent from a control section 61 formed by a predetermined electronic control unit (ECU) 71. When electric energy is to be supplied to the ignition plug 1, a current is supplied from the battery 56 to the primary coil 52 so as to form a magnetic field around the core 54, and the supply of electricity from the battery 56 to the primary coil 52 is stopped by changing the energization signal from the control section 61 from an ON level to an OFF level. As a result of stoppage of the supply of electricity, the magnetic field of the core 54 changes, and the secondary coil 53 generates electric energy of negative polarity. This electric energy is applied to the ignition plug 1 (the spark discharge gap 33), whereby spark discharge can be generated at the spark discharge gap 33.

In the present embodiment, the energy output from the power supply 51 so as to produce spark discharge of one unit (spark discharge during a single cycle) is set to 100 mJ or greater (notably, in the case where spark discharge is produced one time during a single cycle, the output energy refers to an output energy required to produce spark discharge one time, and in the case where spark discharge is produced a plurality of times during a single cycle, the output energy refers to the sum total of energies each required to produce each spark discharge). As a result of supply of such large energy, spark discharge is produced at the spark discharge gap 33, and a spreading force toward the forward end side in the direction of the axis CL1 (namely, toward the center of a combustion chamber) is applied to the produced spark (flame) by the large energy. Notably, in the case where the energy output from the power supply 51 so as to produce one spark discharge is less than 100 mJ, although spark discharge is produced by the supplied electric energy, there does not occur a phenomenon that a spreading force toward the forward end side in the direction of the axis CL1 is applied to the produced spark (flame) by the electric energy, and the flame simply propagates with elapse of time.

Also, in the present embodiment, the ground electrode 27 is configured as follows in consideration of the above-described feature; i.e., the output energy of the power supply 51 is set to 100 mJ or greater and a spreading force toward the forward end side in the direction of the axis CL1 is applied to the spark (flame) by the applied energy.

Figure 4:
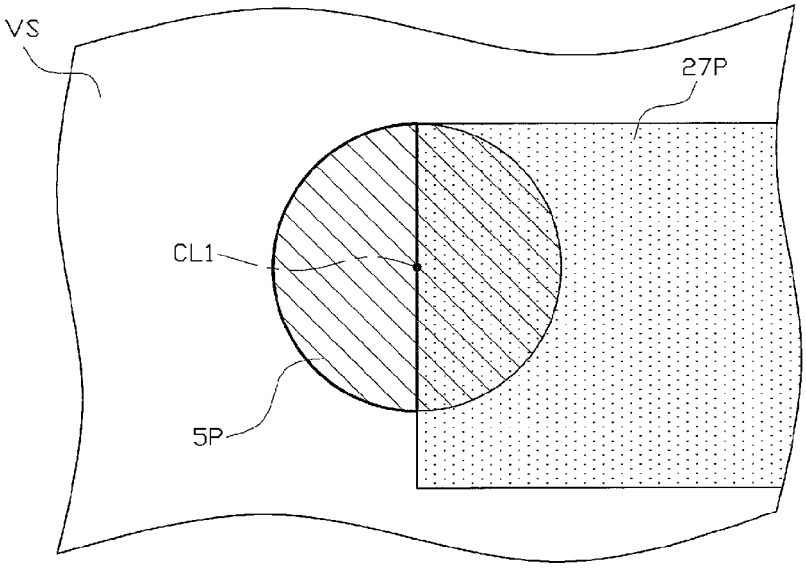
FIG. 4 is a projection view of a forward end portion of a center electrode and a ground electrode.

Namely, as shown in FIG. 4, the forward end portion of the center electrode 5 and the ground electrode 27 are projected along the axis CL1 on a plane VS orthogonal to the axis CL1. The area of a region (a region surrounded by a thick line in FIG. 4) which is obtained by removing, from a projection region 5P (a hatched portion in FIG. 4) of the center electrode 5, a region where the projection region 5P overlaps with a projection region 27P (a dotted portion in FIG. 4) of the ground electrode 27 is represented by S1 ($mm^2$), and the area of the projection region 5P of the center electrode 5 is represented by S2 ($mm^2$) In such a case, the ground electrode 27 is configured such that $S1 \geq [\{-30\ (mm^{-1}) \times G1 + 60\}/100] \times S2$ is satisfied. Namely, the ground electrode 27 is configured such that the smaller the size G1 of the spark discharge gap 33 (i.e., the greater the degree to which the spreading of flame toward the forward end side in the direction of the axis CL1 is hindered by the ground electrode 27) the smaller the area of a region in which the forward end surface of the center electrode 5 and the distal end portion of the ground electrode 27 face each other (hereinafter such area may be referred to as the "facing area between the center electrode 5 and the ground electrode 27").

Meanwhile, if the facing area between the center electrode 5 and the ground electrode 27 becomes excessively small, spark discharge is generated locally between the two electrodes 5 and 27, and the size of the spark discharge gap 33 may increase quickly. In view of this, in present embodiment, the ground electrode 27 is configured such that $S1 \leq 0.8 \times S2$ is satisfied. Namely, the ground electrode 27 is configured such that the area of a portion of the forward end surface of the center electrode 5, which portion does not face the distal end portion of the ground electrode 27, becomes equal to or less than 80% of the area of the forward end surface of the center electrode 5 (in other words, the area of a portion of the forward end surface of the center electrode 5, which portion faces the distal end portion of the ground electrode 27, becomes equal to or greater than 20% of the area of the forward end surface of the center electrode 5).

Figure 5:
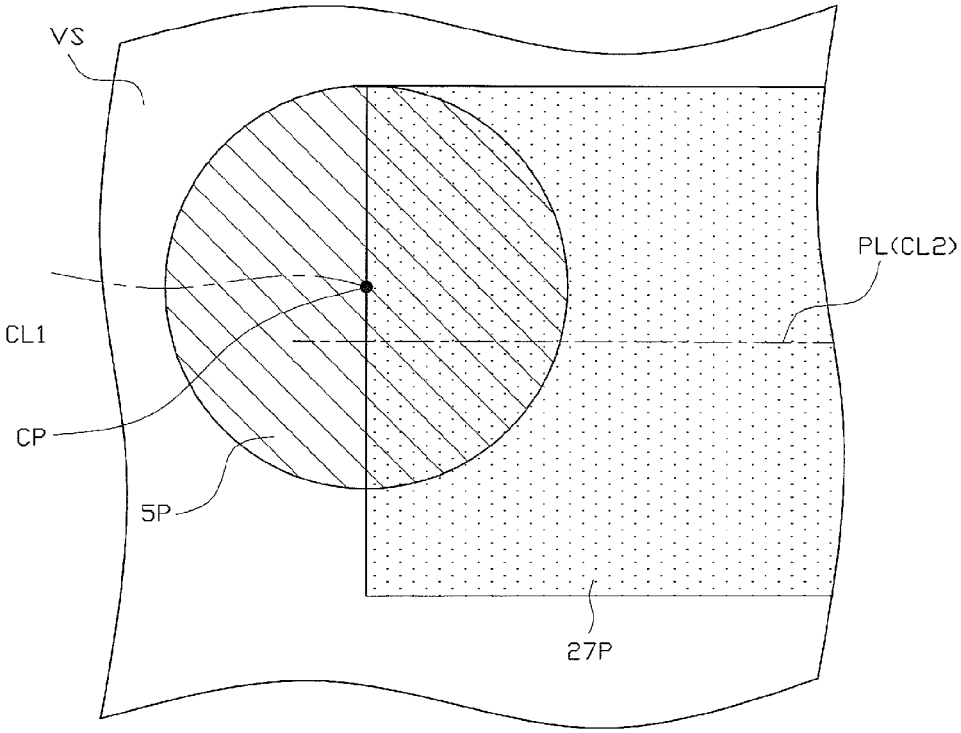
FIG. 5 is a projection view showing the positional relation between a projection line of the center axis of the ground electrode and the center of a projection region of the center electrode.

In addition, in the present embodiment, the ground electrode 27 is configured such that, when a forward end portion of the center electrode 5, the ground electrode 27, and the center axis CL2 (see FIG. 3) of the ground electrode 27 are projected along the axis CL1 on the plane VS orthogonal to the axis CL1 as shown in FIG. 5, at least a portion of the projection region 27P of the ground electrode 27 overlaps with the projection region 5P of the center electrode 5, and the projection line PL of the center axis CL2 is located at a position offset from the center CP of the projection region 5P of the center electrode 5. Namely, the position of the ground electrode 27 is set such that the center axis CL2 is located at a position offset from the center of the forward end surface of the center electrode 5 when viewed from the forward end side in the direction of the axis CL1.

As having been described in detail, according to the present embodiment, the energy output from the power supply 51 for producing spark discharge of one unit is set to 100 mJ or greater. Accordingly, it is possible not only to merely produce spark (flame) at the spark discharge gap 33 by using the electric energy, but also to apply a spreading force toward the forward end side (toward the center of a combustion chamber) to the spark (flame) by using the electric energy.

Figure 6A:
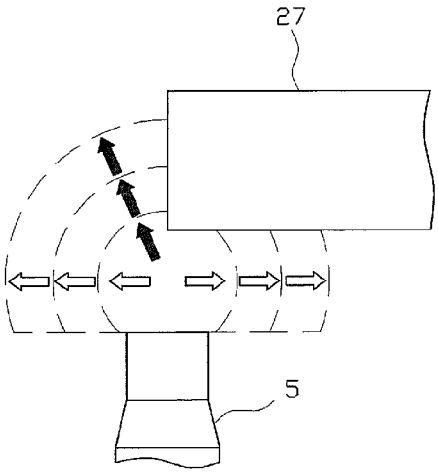
FIG. 6 are views each schematically showing the growth of spark (flame), wherein (a) is an enlarged front schematic view, and (b) is an enlarged side schematic view
Figure 6B:
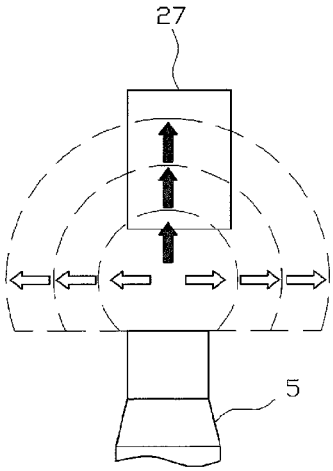

In the present embodiment configured such that a spreading force toward the forward end side is applied to spark (flame), $S1 \geq [\{-30\ (mm^{-1}) \times G1 + 60\}/100] \times S2$ is satisfied. Accordingly, it is possible to effectively prevent the ground electrode 27 from hindering the spreading of the spark (flame) toward the forward end side. As shown in FIGS. 6(*a*)

and 6(*b*), the spreading force toward the forward end side (force indicated by black arrows in FIGS. 6(*a*) and 6(*b*)) which is produced by rendering the output energy equal to or greater than 100 mJ can be utilized to a sufficient degree, whereby the spark (flame) can be grown quickly toward the forward end side (toward the center of a combustion chamber). As a result, excellent ignition performance can be realized. Notably, in FIGS. 6(*a*) and 6(*b*), the growth of the spark (flame) is schematically shown by broken lines. Also, white arrows in FIGS. 6(*a*) and 6(*b*) show propagation directions of the spark (flame). Even in the case where the output energy is lower than 100 mJ or the areas S1 and S2 do not satisfy the above-described relational expression, the spark (flame) propagates in the directions indicated by the white arrows.

Further, in the present embodiment, since $S1 \leq 0.8 \times S2$ is satisfied, the facing area between the center electrode 5 and the ground electrode 27 can be secured sufficiently at the spark discharge gap 33. Accordingly, local wear of the center electrode 5 and/or the ground electrode 27 due to spark discharge can be suppressed more reliably, whereby good durability can be attained.

In addition, in the present embodiment, the center axis CL2 is located at a position offset from the center of the forward end surface of the center electrode 5 when viewed from the forward end side in the direction of the axis CL1. Therefore, a corner portion between a surface of the ground electrode 27 located on the side toward the center electrode 5 and a side surface adjacent to the surface (a portion where electric field intensity becomes high and from which spark discharge starts) can be made closer to the forward end portion of the center electrode 5. Accordingly, a larger number of portions from which spark discharge starts can be formed, whereby local wear of the center electrode 5 and/or the ground electrode 27 can be suppressed more effectively. As a result, durability can be improved further.

Second Embodiment

Figure 7:
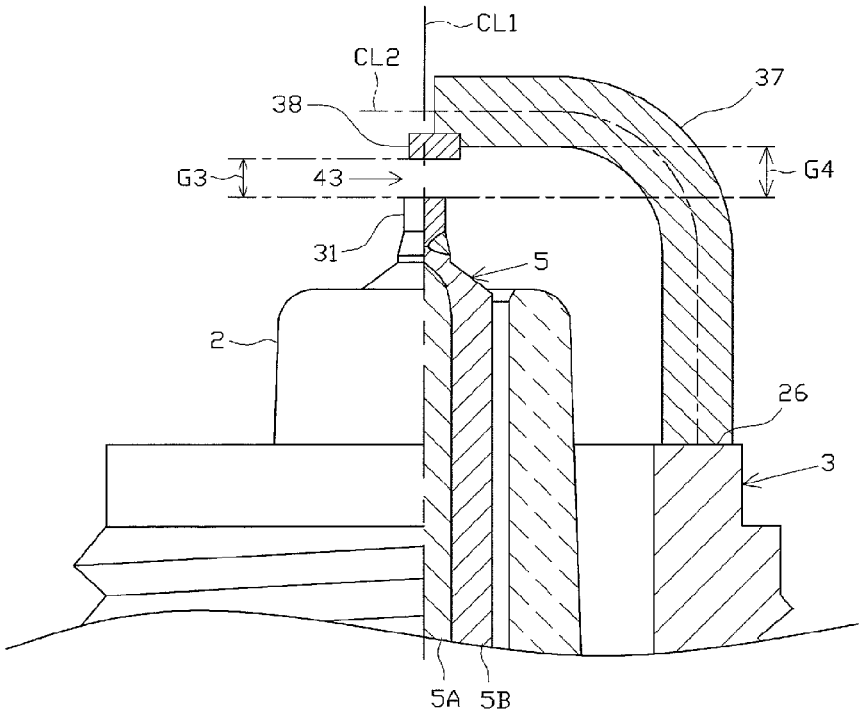
FIG. 7 is a partially cutaway enlarged front view showing the structure of an ignition plug in a second embodiment.

Next, there will be described a second embodiment, mainly with reference to the differences from the first embodiment. In the first embodiment, the spark discharge gap 33 is formed between the forward end portion of the center electrode 5 and the distal end portion of the ground electrode 27. In contrast, in the second embodiment, as shown in FIG. 7, a spark discharge gap 43 is formed between the center electrode 5 and a protrusion 38 provided on the distal end portion of the ground electrode 37. Notably, the protrusion 38 is formed of a metal which is excellent in wear resistance (e.g., Ir, Pt, Rh, Ru, Re, W, Pd, or an alloy which contains at least one of these metals as a main component), and is joined to the distal end portion of the ground electrode 37 by resistance welding.

Further, in the present second embodiment, the protrusion 38 projects toward the center electrode 5 side from the surface of the ground electrode 37 located on the side toward the center electrode 5. Therefore, $G3 < G4$ is satisfied, where G3 (mm) represents the size of the spark discharge gap 43 (the shortest distance between the center electrode 5 and the protrusion 38), and G4 (mm) represents the shortest distance between the ground electrode 37 and the forward end portion of the center electrode 5. Also, in the second embodiment, $G3 < 2.0$ and $G4 < 2.0$ are satisfied.

Figure 8:
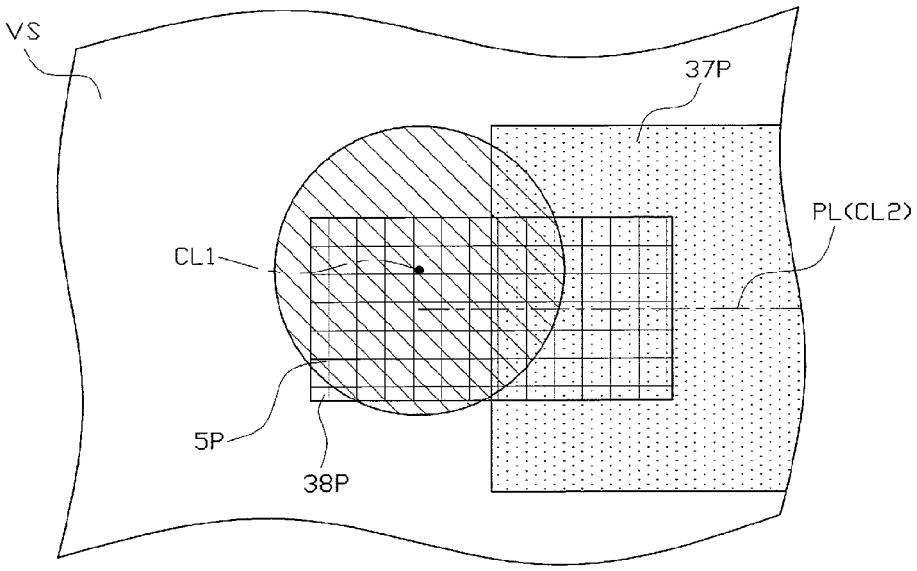
FIG. 8 is a projection view of a forward end portion of a center electrode, a ground electrode, and a protrusion in the second embodiment.

In addition, as shown in FIG. 8, the forward end portion of the center electrode 5, the ground electrode 37, and the protrusion 38 are projected along the axis CL1 on the plane VS orthogonal to the axis CL1. The area of the projection region 5P (a hatched portion in FIG. 8) of the center electrode 5 is represented by S2 ($mm^2$). The area of a region which is obtained by removing, from the projection region 5P of the center electrode 5, a projection region 38P (a portion with a lattice pattern in FIG. 8) of the protrusion 38 is represented by S3 ($mm^2$) The area of a region which is obtained by removing, from the projection region 5P of the center electrode 5, the projection region 37P (a dotted portion in FIG. 8) of the ground electrode 37 and the projection region 38P of the protrusion 38 is represented by S4 ($mm^2$) In this case, $S3 \geq [\{-30\ (mm^{-1}) \times G3 + 60\}/100] \times S2$ and $S4 \geq [\{-30\ (mm^{-1}) \times G4 + 60\}/100] \times S2$ are satisfied. Namely, the ignition plug is configured such that the smaller the size G3 of the spark discharge gap 43 (i.e., the greater the degree to which spreading of flame toward the forward end side in the direction of the axis CL1 is hindered by the protrusion 38), the smaller the facing area between the forward end surface of the center electrode 5 and the protrusion 38. Also, the ignition plug is configured such that the smaller the above-mentioned shortest distance G4 (i.e., the greater the degree to which spreading of flame toward the forward end side in the direction of the axis CL1 is hindered by the ground electrode 37 and the protrusion 38), the smaller the facing area between the forward end surface of the center electrode 5 and "the ground electrode 37 and the protrusion 38."

Moreover, in the present second embodiment, at least one of $S3 \leq 0.8 \times S2$ and $S4 \leq 0.8 \times S2$ is satisfied (in the present embodiment, both are satisfied).

Figure 9A:
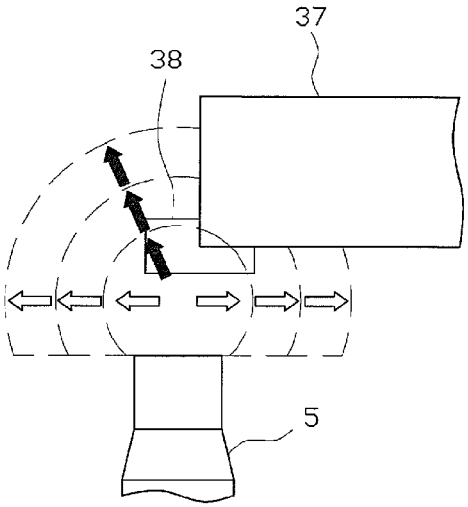
FIG. 9 are views each schematically showing the growth of spark (flame) in the second embodiment, wherein (a) is an enlarged front schematic view, and (b) is an enlarged side schematic view.
Figure 9B:
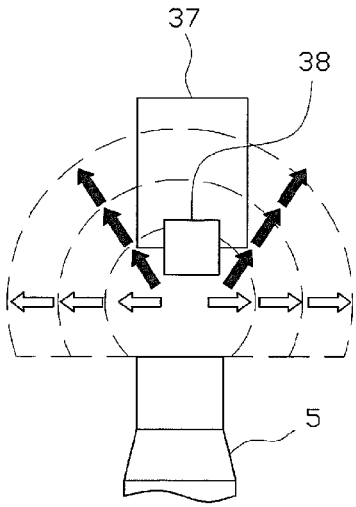

The present second embodiment achieves an action and an effect which are basically the same as those of the above-described first embodiment. Namely, as shown in FIGS. 9(*a*) and 9(*b*), a spreading force toward the forward end side (force indicated by black arrows in FIGS. 9(*a*) and 9(*b*)) can be applied to spark (flame) by rendering the output energy equal to or greater than 100 mJ. In addition, the spreading force can be utilized sufficiently by configuring the ignition plug such that the areas S3 and S4 satisfy the above-described expressions. Thus, the spark (flame) can be grown quickly toward the forward end side (toward the center of a combustion chamber). As a result, excellent ignition performance can be realized. Notably, in FIGS. 9(*a*) and 9(*b*), the growth of the spark (flame) is schematically shown by broken lines. Also, white arrows in FIGS. 9(*a*) and 9(*b*) show propagation directions of the spark (flame). Even in the case where the output energy is lower than 100 mJ or the areas S1 and S2 do not satisfy the above-described relational expression, the spark (flame) propagates in the directions indicated by the white arrows.

Also, since $S3 \leq 0.8 \times S2$ is satisfied, the facing area between the protrusion 38 and the center electrode 5 can be secured sufficiently at the spark discharge gap 43. Accordingly, local wear of the protrusion 38 and/or the center electrode 5 due to spark discharge can be suppressed more reliably, whereby durability can be improved.

Further, since $S4 \leq 0.8 \times S2$ is satisfied, the facing area between "the protrusion 38 and the ground electrode 27" and the center electrode 5 can be secured sufficiently. As a result, local wear of the ground electrode 27 and/or the center electrode 5 can be suppressed, whereby durability can be improved further.

In order to confirm the action and effect achieved by the above-described embodiments, an ignition performance evaluation test was performed for samples of the ignition system which were differed in the output energy (mJ) from the power supply for producing spark discharge of one unit, the size G1 (mm) of the spark discharge gap, and the outer diameter (mm) of the forward end surface of the center electrode. The ratio of the area S1 ($mm^2$) to the area S2 ($mm^2$) (S1/S2; hereinafter referred to as the "area ratio") of the samples of the ignition system was changed among various ratios. The outline of the ignition performance evaluation test is as follows. The ignition plug of each sample was attached to a 1.5 L four-cylinder engine, and the engine was operated at 1600 rpm with the suction negative pressure set to −350 mg. The air-fuel ratio (A/F) was increased gradually (the fuel was made thin gradually), and the air-fuel ratio at the time when misfire occurred in 10 cycles or more per 1000 cycles was specified as a limit air-fuel ratio. While the limit air-fuel ratio of the sample in which the area S1 was set to 0 $mm^2$ was used as a reference, the amount of increase from the reference limit air-fuel ratio (air-fuel ratio increase amount) was calculated for each sample. Notably, a sample which has a larger air-fuel ratio increase amount is less likely to cause misfire even in a state in which fuel is thin, and is more excellent in ignition performance.

Figure 10:
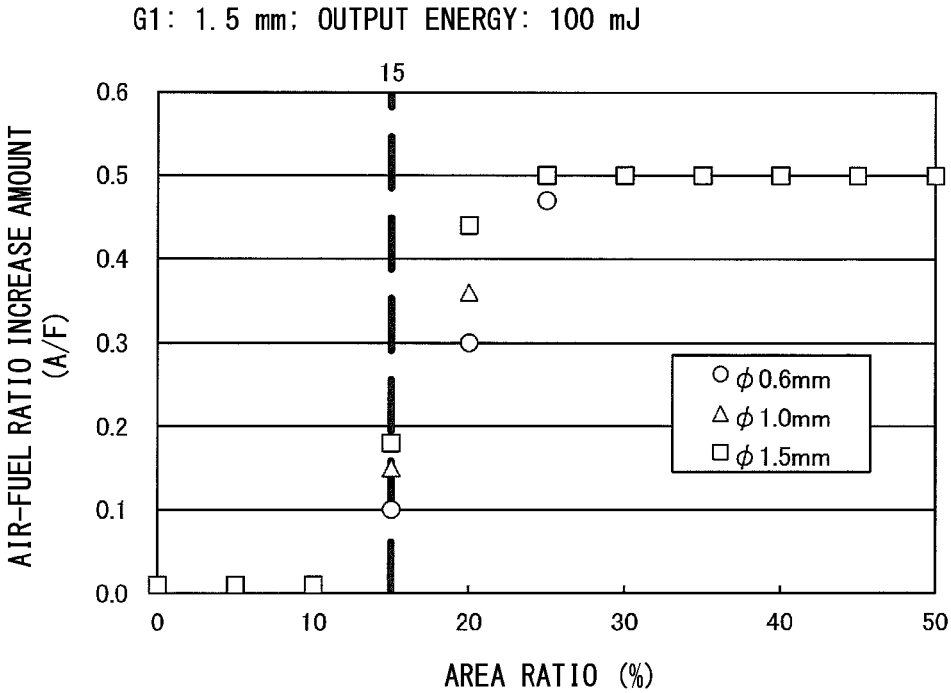
FIG. 10 is a graph showing the result of an ignition performance evaluation test performed for samples in which the size of the spark discharge gap was set to 1.5 mm, and the output energy was set to 100 mJ.
Figure 11:
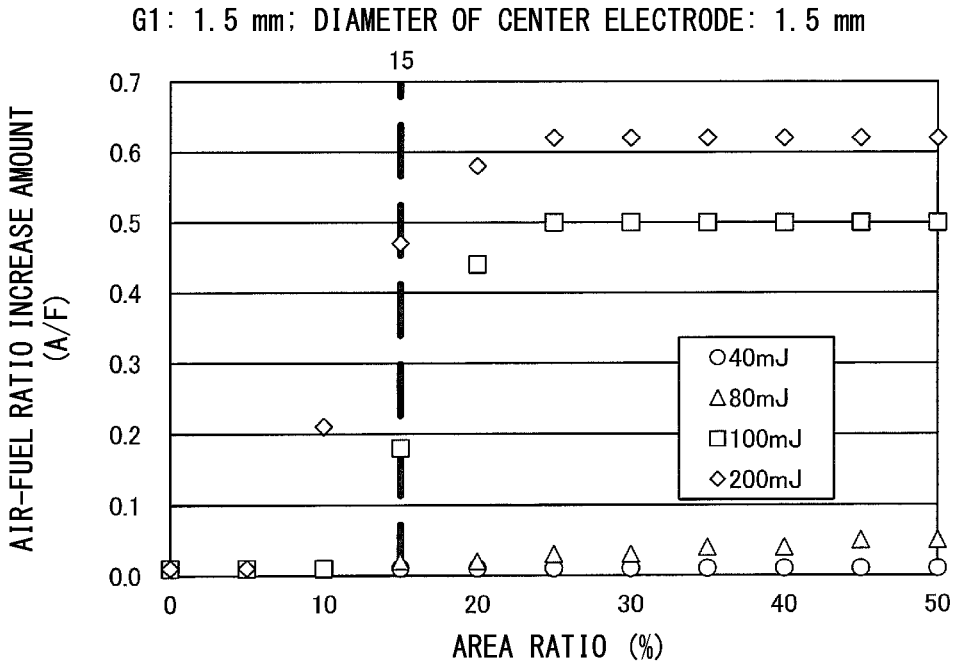
FIG. 11 is a graph showing the result of an ignition performance evaluation test performed for samples in which the size of the spark discharge gap was set to 1.5 mm, and the outer diameter of the forward end surface of the center electrode was set to 1.5 mm.
Figure 12:
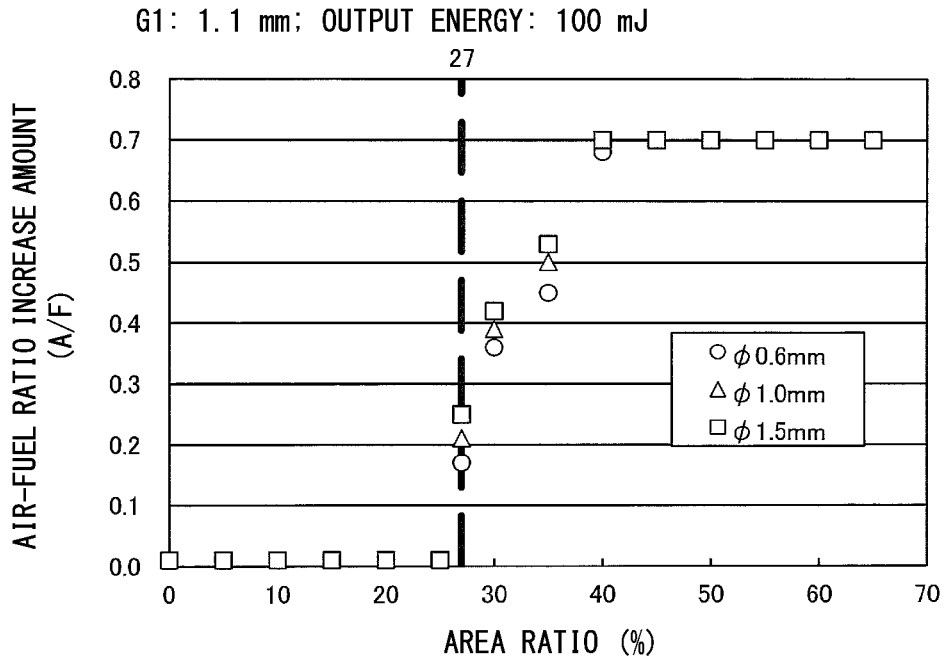
FIG. 12 is a graph showing the result of an ignition performance evaluation test performed for samples in which the size of the spark discharge gap was set to 1.1 mm, and the output energy was set to 100 mJ.
Figure 13:
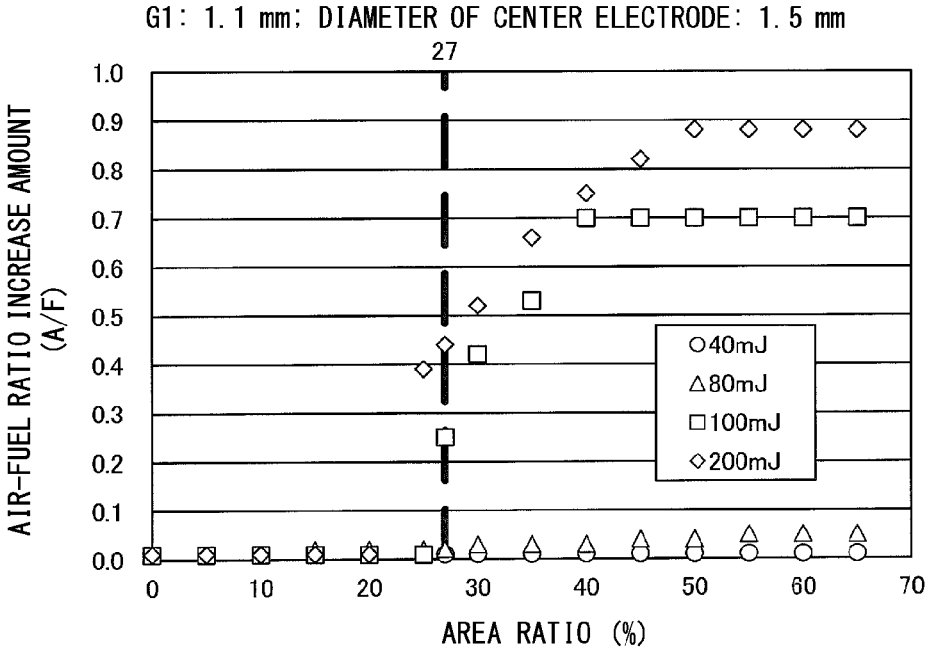
FIG. 13 is a graph showing the result of an ignition performance evaluation test performed for samples in which the size of the spark discharge gap was set to 1.1 mm, and the outer diameter of the forward end surface of the center electrode was set to 1.5 mm.
Figure 14:
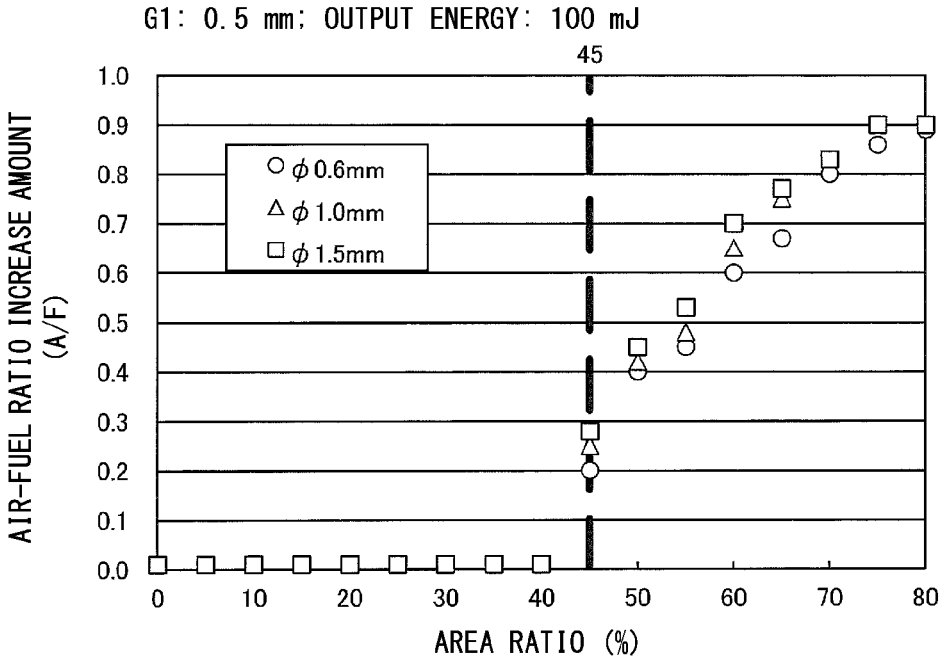
FIG. 14 is a graph showing the result of an ignition performance evaluation test performed for samples in which the size of the spark discharge gap was set to 0.5 mm, and the output energy was set to 100 mJ.
Figure 15:
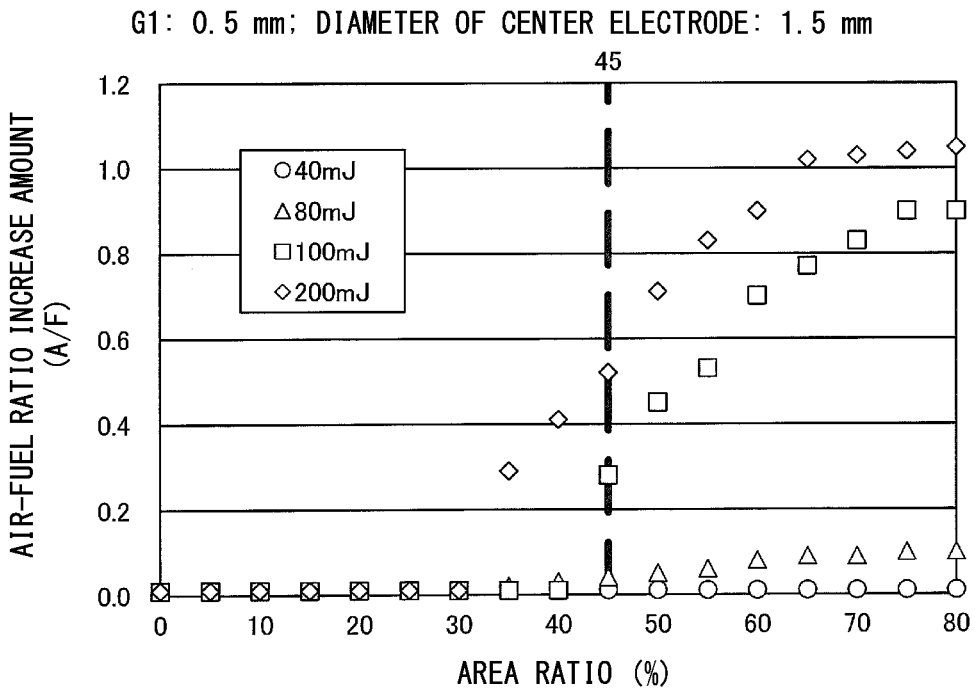
FIG. 15 is a graph showing the result of an ignition performance evaluation test performed for samples in which the size of the spark discharge gap was set to 0.5 mm, and the outer diameter of the forward end surface of the center electrode was set to 1.5 mm.

FIG. 10 shows the results of a test in which the size G1 of the spark discharge gap was set to 1.5 mm and the output energy was set to 100 mJ and in which the outer diameter of the forward end surface of the center electrode and the area ratio were changed. FIG. 11 shows the results of a test in which the size G1 of the spark discharge gap was set to 1.5 mm and the outer diameter of the forward end surface of the center electrode was set to 1.5 mm and in which the output energy and the area ratio were changed. FIG. 12 shows the results of a test in which the size G1 of the spark discharge gap was set to 1.1 mm and the output energy was set to 100 mJ and in which the outer diameter of the forward end surface of the center electrode and the area ratio were changed. FIG. 13 shows the results of a test in which the size G1 of the spark discharge gap was set to 1.1 mm and the outer diameter of the forward end surface of the center electrode was set to 1.5 mm and in which the output energy and the area ratio were changed. FIG. 14 shows the results of a test in which the size G1 of the spark discharge gap was set to 0.5 mm and the output energy was set to 100 mJ and in which the outer diameter of the forward end surface of the center electrode and the area ratio were changed. FIG. 15 shows the results of a test in which the size G1 of the spark discharge gap was set to 0.5 mm and the outer diameter of the forward end surface of the center electrode was set to 1.5 mm and in which the output energy and the area ratio were changed.

Notably, in FIGS. 10, 12, and 14, the test results of samples in which the outer diameter of the forward end surface of the center electrode was set to 0.6 mm are plotted by circular marks, the test results of samples in which the outer diameter of the forward end surface of the center electrode was set to 1.0 mm are plotted by triangular marks, and the test results of samples in which the outer diameter of the forward end surface of the center electrode was set to 1.5 mm are plotted by square marks. Also, in FIGS. 11, 13, and 15, the test results of samples in which the output energy was set to 40 mJ are plotted by circular marks, the test results of samples in which the output energy was set to 80 mJ are plotted by triangular marks, the test results of samples in which the output energy was set to 100 mJ are plotted by square marks, and the test results of samples in which the output energy was set to 200 mJ are plotted by rhombic marks.

As shown in FIGS. 10 and 11, it was found that, in the samples in which the size G1 of the spark discharge gap is set to 1.5 mm, the ignition performance can be improved by making the area ratio equal to or greater than 15% when the output energy is set to 100 mJ or greater. Also, as shown in FIGS. 12 and 13, it was confirmed that, in the samples in which the size G1 of the spark discharge gap is set to 1.1 mm, the ignition performance can be improved by making the area ratio equal to or greater than 27% when the output energy is set to 100 mJ or greater. Further, as shown in FIGS. 14 and 15, it was revealed that, in the samples in which the size G1 of the spark discharge gap is set to 0.5 mm, the ignition performance can be improved by making the area ratio equal to or greater than 45% when the output energy is set to 100 mJ or greater.

Figure 16:
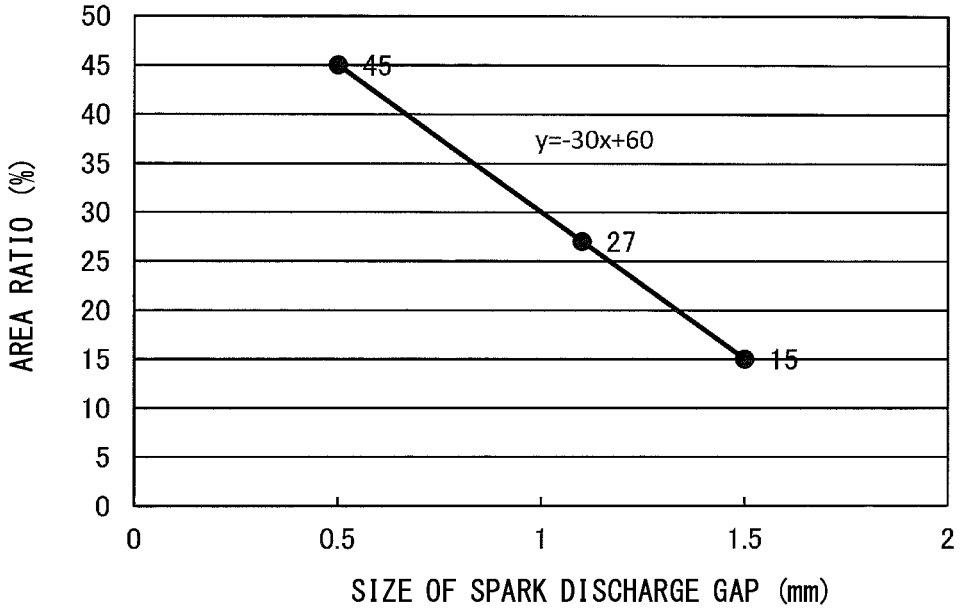
FIG. 16 is a graph showing the relation between the size of the spark discharge gap and the minimum value of the area ratio which can improve ignition performance.

On the basis of the obtained test results, there was determined the minimum value of the area ratio at which the ignition performance was able to be increased when the output energy was set to 100 mJ or greater. As shown in FIG. 16, it was found that the ignition performance improves when $y \geq -30x+60$ is satisfied, where x represents the size G1 of the spark discharge gap, and y represents the area ratio. Namely, it became clear that the ignition performance improves when the output energy is set to 100 mJ or greater, and $S1 \geq [\{-30\ (mm^{-1}) \times G1+60\}/100] \times S2$ is satisfied. Conceivably, such improvement was attained because, as a result of synergistic action of the following (1) and (2), spark (flame) quickly grew toward the forward end side in the direction of the axis (toward the center of a combustion chamber).

(1) As a result of the output energy being set to 100 mJ or greater, a spreading force toward the forward end side in the direction of the axis (toward the center of a combustion chamber) is applied to spark (flame) by electric energy.

(2) As a result of $S1 \geq [\{-30\ (mm^{-1}) \times G1+60\}/100] \times S2$ being satisfied, spreading of spark (flame) toward the forward end side in the direction of the axis is less likely to be hindered by the ground electrode.

The following thoughts can be derived from the above-described thought. In an ignition system in which a protrusion is provided on the ground electrode, spreading of spark (flame) toward the forward end side in the direction of the axis is less likely to be hindered by the protrusion when the area S3 ($mm^2$) and the size G3 (mm) of the spark discharge gap formed between the protrusion and the center electrode satisfy $S3 \geq [\{-30\ (mm^{-1}) \times G3+60\}/100] \times S2$. Further, spreading of spark (flame) toward the forward end side in the direction of the axis becomes less likely to be hindered by the protrusion or the ground electrode when the area S4 ($mm^2$) and the shortest distance G4 (mm) between the ground electrode and the center electrode satisfy $S4 \geq [\{-30\ (mm^{-1}) \times G4+60\}/100] \times S2$. Accordingly, when $S3 \geq [\{-30\ (mm^{-1}) \times G3+60\}/100] \times S2$ and $S4 \geq [\{-30\ (mm^{-1}) \times G4+60\}/100] \times S2$ are satisfied, spark (frame) can be quickly grown toward the forward end side in the direction of the axis (toward the center of a combustion chamber), whereby good ignition performance can be attained.

The results of the above-described test show that, in an ignition system in which a spark discharge gap is formed between the ground electrode and the center electrode, in order to improve ignition performance, it is preferable to set the output energy of the power supply for producing spark discharge of one unit (spark discharge during a single cycle) to 100 mJ or greater and to configure the ignition system to satisfy $S1 \geq [\{-30\ (mm^{-1}) \times G1+60\}/100] \times S2$.

Also, in an ignition system in which a protrusion is provided on the ground electrode and a spark discharge gap is formed between the protrusion and the center electrode, in order to improve ignition performance, it is preferable to set the output energy of the power supply for producing spark discharge of one unit (spark discharge during a single cycle) to 100 mJ or greater and to configure the ignition system to satisfy $S3 \geq [\{-30\ (mm^{-1}) \times G3+60\}/100] \times S2$ and $S4 \geq [\{-30\ (mm^{-1}) \times G4+60\}/100] \times S2$.

Figure 17:
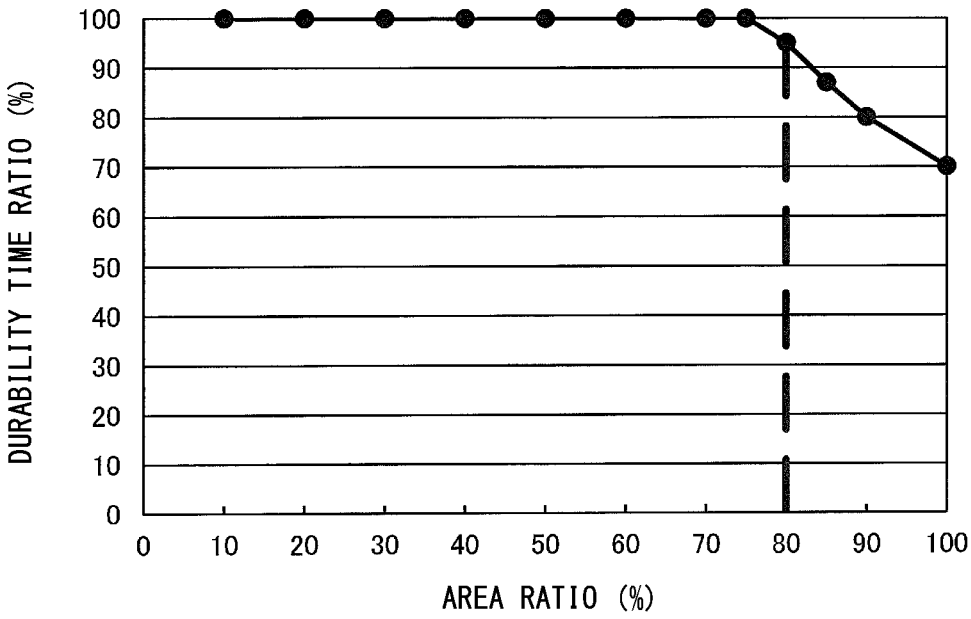
FIG. 17 is a graph showing the result of a durability evaluation test performed for samples having different area ratios.

Next, a durability evaluation test was performed for samples of the ignition system in which the above-mentioned area ratio (S1/S2) was changed among various ratios. The outline of the durability evaluation test is as follows. Namely, the ignition plug of each sample was attached to a predetermined camber, a nitrogen atmosphere was created in the chamber, and the pressure within the chamber was set to 0.4 MPa. The ignition plug was caused to discharge through application of voltage having a frequency of 30 Hz (namely at a rate of 1800 times per min) For each sample, a time (durability time) elapsed until the size of the spark discharge gap increased from an initial size by 0.20 mm or more was measured, and the ratio (durability time ratio) of the measured durability time to the durability time of a sample in which the area S1 was set to 0 $mm^2$ was calculated. Notably, in the sample in which the area S1 is set to 0 $mm^2$, since the facing area between the center electrode and the ground electrode becomes maximum, it is extremely excellent in durability. Accordingly, a sample whose durability time ratio is closer to 100% (namely, whose durability time is closer to the durability time of the sample in which the area S1 is set to 0 $mm^2$) can be said to have excellent durability. FIG. 17 shows the results of the durability evaluation test.

As shown in FIG. 17, it was found that samples in which the area ratio (S1/S2) is set to 80% or greater (i.e., samples which satisfy $S1 \leq 0.8 \times S2$) have durability time ratios equal to or greater than 95% and are excellent in durability. Conceivably, this is because the facing area between the center electrode and the ground electrode was secured sufficiently, and local wear of the center electrode and/or the ground electrode due to spark discharge was suppressed more reliably.

Also, the following thoughts are derived from the above-described thought. In an ignition system in which a protrusion is provided on the ground electrode, local wear of the protrusion and/or the center electrode can be suppressed when the area ratio (S3/S2) is 80% or greater (namely, $S3 \leq 0.8 \times S2$ is satisfied). Further, local wear of the ground electrode, the protrusion and/or the center electrode can be suppressed when the area ratio (S4/S2) is 80% or greater (namely, $S4 \leq 0.8 \times S2$ is satisfied). Accordingly, when at least one of $S3 \leq 0.8 \times S2$ and $S4 \leq 0.8 \times S2$ is satisfied, good durability can be attained, and when $S3 \leq 0.8 \times S2$ and $S4 \leq 0.8 \times S2$ are both satisfied, extremely good durability can be attained.

The results of the above-described test show that, in an ignition system in which a spark discharge gap is formed between the ground electrode and the center electrode, in order to improve durability, it is preferable to configure the ignition system to satisfy $S1 \leq 0.8 \times S2$.

Also, in an ignition system in which a protrusion is provided on the ground electrode and a spark discharge gap is formed between the protrusion and the center electrode, in order to improve durability, it is preferable to satisfy at least one of $S3 \leq 0.8 \times S2$ and $S4 \leq 0.8 \times S2$, more preferably, both of them.

Figure 18:
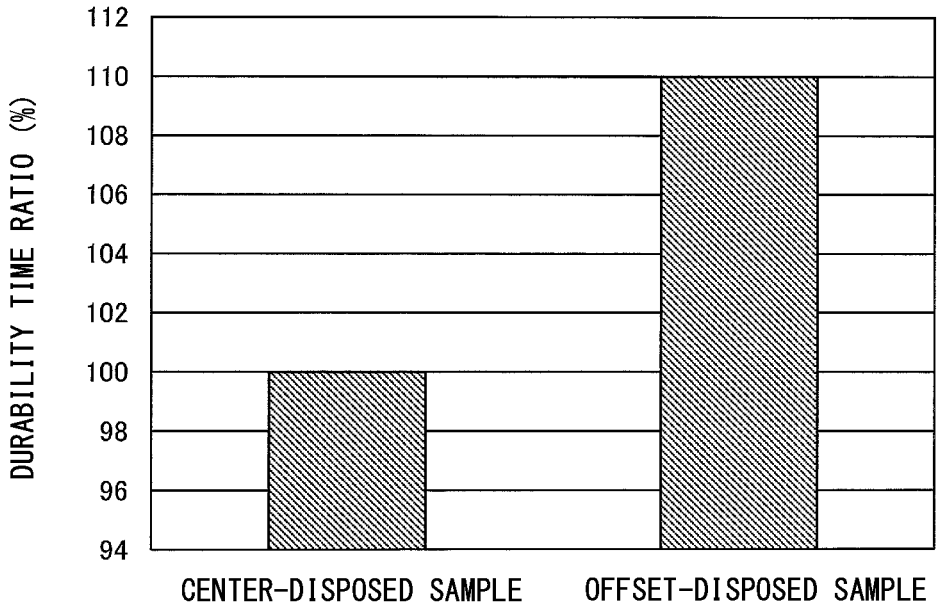
FIG. 18 is a graph showing durability time ratios of a center-disposed sample and an offset-disposed sample.

Next, there were made a sample (center-disposed sample) of the ignition system in which the size G1 of the spark discharge gap was set to 1.1 mm, the area ratio (S1/S2) was set to 30%, and when the forward end portion of the center electrode and the center axis of the ground electrode were projected along the axis on a plane orthogonal to the axis, the projection line of the center axis overlapped with the center of the projection region of the center electrode; and a sample (offset-disposed sample) of the ignition system in which the size G1 of the spark discharge gap was set to 1.1 mm, the area ratio (S1/S2) was set to 30%, and the projection line of the center axis was located at a position offset from the center of the projection region of the center electrode. The above-described durability evaluation test was performed for these two samples. The ratio (durability time ratio) of the durability time of the offset-disposed sample to the durability time of the center-disposed sample was calculated. FIG. 18 shows the result of this test.

As shown in FIG. 18, it was found that the offset-disposed sample in which the projection line of the center axis is located at a position offset from the center of the projection region of the center electrode has further improved durability. Conceivably, this is because, as a result of the ground electrode being offset, a corner portion between a surface of the ground electrode located on the side toward the center electrode and a side surface adjacent to the surface (a portion where electric field intensity becomes high and from which spark discharge starts) was located closer to the forward end portion of the center electrode, whereby a larger number of portions from which spark discharge starts were formed. As a result, local wear of the center electrode and/or the ground electrode was suppressed more effectively.

The results of the above-described test demonstrates that in order to improve durability to a greater extent, the ignition plug is preferably configured such that when the forward end portion of the center electrode and the center axis of the ground electrode were projected along the axis on a plane orthogonal to the axis, the projection line of the center axis is located at a position offset from the center of the projection region of the center electrode.

Notably, the present invention is not limited to the above-described embodiments, but may be embodied, for example, as follows. Of course, applications and modifications other than those described below are also possible.

(a) In the above-described second embodiment, the ground electrode 37 and the protrusion 38 are formed of different materials. However, the ground electrode and the protrusion may be formed of the same material by, for example, deforming the distal end portion of the ground electrode.

Figure 19:
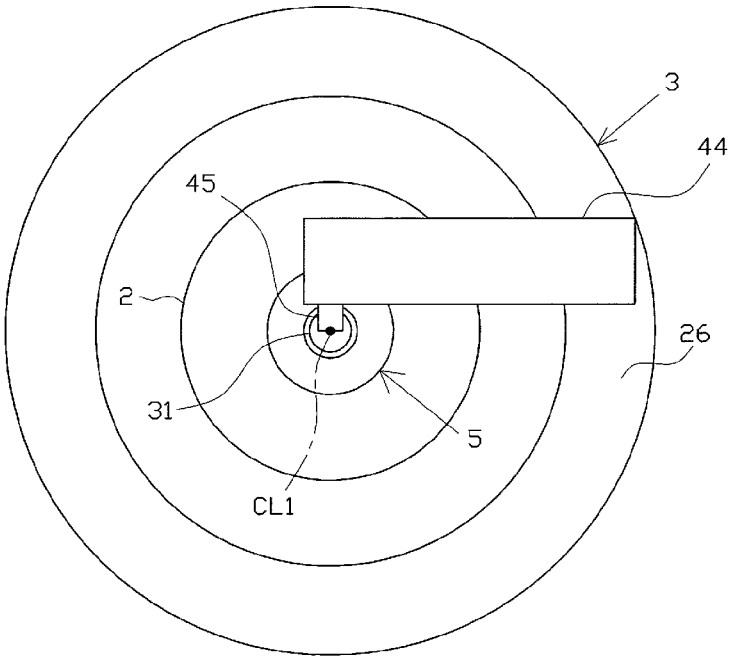
FIG. 19 is a bottom view showing the structure of the protrusion, etc. in another embodiment.

(b) In the above-described second embodiment, the ignition plug is configured such that the ground electrode 37 overlaps with a portion of the forward end portion of the center electrode 5 when viewed from the forward end side in the direction of the axis CL1. In contrast, as shown in FIG. 19, the ignition plug may be configured such that a protrusion 45 projects from a side surface of a ground electrode 44, and when viewed from the forward end side in the direction of the axis CL1, the ground electrode 44 does not overlap with the forward end portion of the center electrode 5 although the protrusion 45 overlaps with the forward end portion of the center electrode 5.

Figure 20:
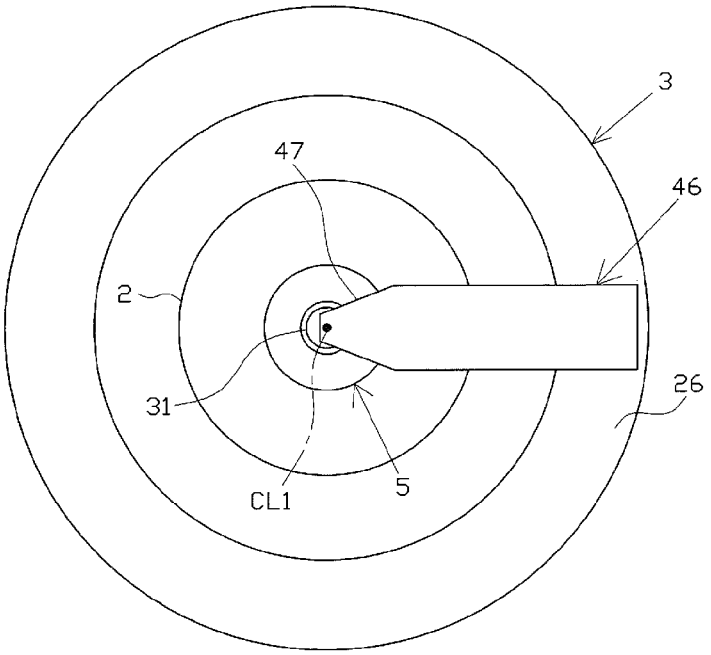
FIG. 20 is a bottom view showing the structure of the ground electrode in another embodiment.

(c) In the above-described embodiments, the ground electrode 27, 37 has a fixed width along the center axis CL2. However, as shown in FIG. 20, a ground electrode 46 may have a taper portion 47 whose width decreases gradually toward the end thereof. This configuration can increase the above-mentioned areas S1 and S4 more reliably, to thereby improve ignition performance more reliably.

(d) In the above-described embodiments, the electric energy from the power supply 51 is supplied to each ignition plug 1 through a distributer. However, the embodiments may be modified such that the power supply 51 is individually provided for each ignition plug 1, and electric energy is supplied from one power supply 51 to one ignition plug 1.

(e) A variable energy power supply may be used as a power supply 51. In this case, when the operation condition of the internal combustion engine is a condition under which ignition performance is likely to drop, a relatively large energy is output from the power supply 51 so as to produce spark discharge of one unit (spark discharge during a single cycle), whereby good ignition performance can be obtained more reliably. Meanwhile, when the operation condition of the internal combustion engine is a condition under which ignition performance is unlikely to drop, a relatively small energy is output from the power supply 51 so as to produce spark discharge of one unit (spark discharge during a single cycle), whereby it becomes possible to suppress wear of the center electrode 5, ground electrode 27, etc. due to spark discharge to thereby improve durability, while maintaining good ignition performance.

(f) In the above-described embodiments, the ground electrode 27 is joined to the forward end portion 26 of the metallic shell 3. However, the present invention can be applied to the case where the ground electrode is formed, through cutting operation, from a portion of the metallic shell (or a portion of a front end metal piece welded to the metallic shell in advance) (see, for example, Japanese Patent Application Laid-Open (kokai) No. 2006-236906).

(g) In the above-described embodiments, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS AND SYMBOLS

1: ignition plug;
2: insulator;
3: metallic shell;
4: axial hole;
5: center electrode;
5P: projection region (of the center electrode);
27, 37: ground electrode;
27P, 37P: projection region (of the ground electrode);
33, 43: spark discharge gap (gap);
38: protrusion;
38P: projection region (of the protrusion);
51: power supply;
101: ignition system;
CL1: axis;
CL2: center axis (of the ground electrode);
CP: center (of the projection region of the center electrode);
PL: projection line (of the center axis).

Having described the invention, the following is claimed:

1. An ignition system comprising:

an ignition plug including a tubular insulator having an axial hole extending in the direction of an axis, a center electrode inserted into a forward end portion of the axial hole, and a rod-shaped ground electrode which forms a gap in cooperation with a forward end portion of the center electrode; and a power supply for supplying electric energy to the gap, wherein spark discharge is produced at the gap when electric energy is supplied from the power supply to the gap, wherein the electric energy output from the power supply for producing spark discharge of one unit is 100 mJ or greater; and $S1 \geq [\{-30\ (mm^{-1}) \times G1+60\}/100] \times S2$, $S1 \leq 0.8 \times S2$, and $G1 < 2.0$ are satisfied wherein G1 represents the size (mm) of the gap, and when the forward end portion of the center electrode and the ground electrode are projected along the axis on a plane orthogonal to the axis, S1 represents an area ($mm^2$) defined with a region obtained by removing, from a projection region of the center electrode, a region where the projection region overlaps with a projection region of the ground electrode, and S2 represents an area ($mm^2$) defined with the projection region of the center electrode.

2. An ignition system comprising:

an ignition plug including a tubular insulator having an axial hole extending in the direction of an axis, a center electrode inserted into a forward end portion of the axial hole, a metallic shell provided around the insulator, a rod-shaped ground electrode disposed on a forward end portion of the metallic shell, and a protrusion which is provided on a distal end portion of the ground electrode and which forms a gap in cooperation with a forward end portion of the center electrode; and a power supply for supplying electric energy to the gap, wherein spark discharge is produced at the gap when electric energy is supplied from the power supply to the gap, wherein the electric energy output from the power supply for producing spark discharge of one unit is 100 mJ or greater; and $S3 \geq [\{-30\ (mm^{-1}) \times G3+60\}/100] \times S2$, $S4 \geq [\{-30\ (mm^{-1}) \times G4+60\}/100] \times S2$, $G3 < 2.0$, and $G4 < 2.0$ are satisfied wherein G3 represents the size (mm) of the gap, G4 represents the shortest distance (mm) between the ground electrode and the forward end portion of the center electrode, and when the forward end portion of the center electrode, the ground electrode, and the protrusion are projected along the axis on a plane orthogonal to the axis, S2 represents an area ($mm^2$) defined with a projection region of the center electrode, S3 represents an area ($mm^2$) defined with a region obtained by removing a projection region of the protrusion from the projection region of the center electrode, and S4 represents an area ($mm^2$) defined with a region obtained by removing a projection region of the ground electrode and the projection region of the protrusion from the projection region of the center electrode.

3. An ignition system according to claim 2, wherein at least one of $S3 \leq 0.8 \times S2$ and $S4 \leq 0.8 \times S2$ is satisfied.

4. An ignition system according to claim 1, wherein when the forward end portion of the center electrode, the ground electrode, and a center axis of the ground electrode are projected along the axis on a plane orthogonal to the axis, at least a portion of the projection region of the ground electrode overlaps with the projection region of the center electrode, and a projection line of the center axis is located at a position offset from the center of the projection region of the center electrode.

5. An ignition system according to claim 2, wherein when the forward end portion of the center electrode, the ground electrode, and a center axis of the ground electrode are projected along the axis on a plane orthogonal to the axis, at least a portion of the projection region of the ground electrode overlaps with the projection region of the center electrode, and a projection line of the center axis is located at a position offset from the center of the projection region of the center electrode.

* * * * *